US012312780B2

(12) United States Patent
Rübesamen et al.

(10) Patent No.: US 12,312,780 B2
(45) Date of Patent: May 27, 2025

(54) FASTENER FOR A SANITARY FAUCET, A SANITARY FAUCET HAVING A FASTENER AND A METHOD FOR SECURING A SANITARY FAUCET TO A SUPPORT

(71) Applicant: Grohe AG, Hemer (DE)

(72) Inventors: Paul Rübesamen, Meschede (DE); Hendrik Begerow, Hemer (DE); Stephan Venus, Menden (DE); Franziska Kalka, Soest (DE); Hendrik Heitkamp, Dortmund (DE); Bertrand Tchana Tchuinou, Hagen (DE); Pei Guo, Menden (DE); Horst Bachmann, Bochum (DE)

(73) Assignee: GROHE AG, Hemer (DE)

( * ) Notice: Subject to any disclaimer, the term of this patent is extended or adjusted under 35 U.S.C. 154(b) by 223 days.

(21) Appl. No.: 17/928,021

(22) PCT Filed: May 5, 2021

(86) PCT No.: PCT/EP2021/061832

§ 371 (c)(1),
(2) Date: Nov. 28, 2022

(87) PCT Pub. No.: WO2021/239417

PCT Pub. Date: Dec. 2, 2021

(65) Prior Publication Data

US 2023/0212843 A1 Jul. 6, 2023

(30) Foreign Application Priority Data

May 29, 2020 (DE) ..... 102020114523.3

(51) Int. Cl.
*E03C 1/04* (2006.01)
*E03C 1/02* (2006.01)

(52) U.S. Cl.
CPC ..... *E03C 1/0402* (2013.01); *E03C 1/0403* (2013.01); *E03C 2001/026* (2013.01); *E03C 2001/0416* (2013.01)

(58) Field of Classification Search
CPC ..... E03C 2001/0416; E03C 2001/026; E03C 1/0402; E03C 1/0403
(Continued)

(56) References Cited

U.S. PATENT DOCUMENTS 6,006,784 A 12/1999 Tsutsui et al.
6,394,132 B1 * 5/2002 Walcome ..... F16L 37/32 251/149.6
(Continued)

FOREIGN PATENT DOCUMENTS

DE 295 16 157 2/1997
DE 100 22 350 11/2001
(Continued)

OTHER PUBLICATIONS

International Search Report issued Jun. 24, 2021, in International (PCT) Application No. PCT/EP2021/061832, with English translation.

*Primary Examiner* — Huyen D Le
(74) *Attorney, Agent, or Firm* — Wenderoth, Lind & Ponack, L.L.P.

(57) ABSTRACT

A fastener (1) for a sanitary faucet (2) that contains a coupling body (3) that can be at least partially secured in an opening (4) of a support (5), wherein the sanitary faucet (2) can be detachably secured to the coupling body (3); at least one supply channel (6, 7) through which a liquid can be supplied to the sanitary faucet (2); and at least one valve (8, 9) that opens the at least one supply channel (6, 7) when the sanitary faucet (2) is secured to the coupling body (3) and closes the at least one supply channel (6, 7) when the sanitary faucet (2) is not secured to the coupling body (3).
(Continued)

Figure 1:
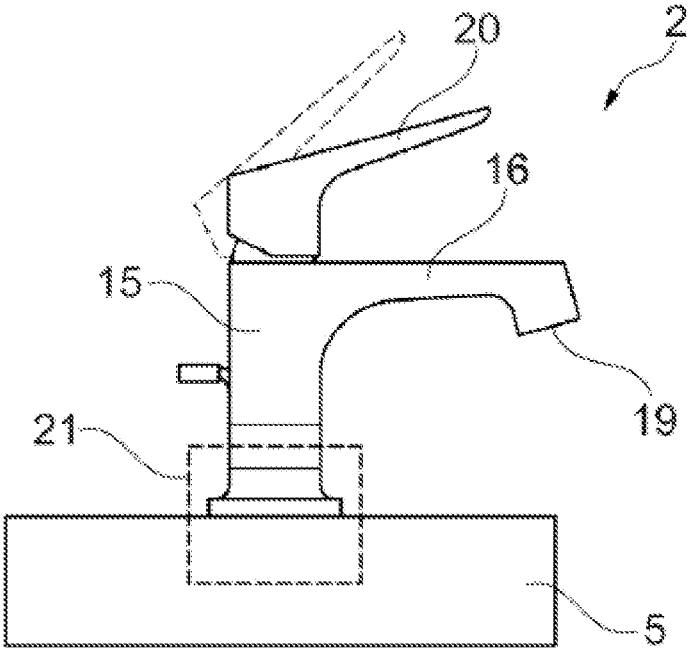

In addition, a sanitary faucet (2) having such a fastener (1) and a method for securing the sanitary faucet (2) to the support (5) are proposed.

8 Claims, 3 Drawing Sheets

(58) Field of Classification Search
USPC ..... 4/695
See application file for complete search history.

(56) References Cited

U.S. PATENT DOCUMENTS

| | | | | |
|---|---|---|---|---|
| 2003/0204906 | A1* | 11/2003 | Tsutsui | E03C 1/0403 4/695 |
| 2006/0185076 | A1* | 8/2006 | Huber | E03C 1/0403 4/677 |
| 2008/0289697 | A1* | 11/2008 | Lin | F16K 43/005 137/315.12 |
| 2008/0289698 | A1* | 11/2008 | Lin | E03C 1/0403 137/315.12 |
| 2013/0291959 | A1* | 11/2013 | Chen | E03C 1/0401 137/315.01 |
| 2017/0101765 | A1* | 4/2017 | Song | E03C 1/0402 |

FOREIGN PATENT DOCUMENTS

| | | |
|---|---|---|
| DE | 20 2013 004 255 | 5/2013 |
| GB | 2 371 350 | 7/2002 |
| JP | 2002-206263 | 7/2002 |

* cited by examiner

FASTENER FOR A SANITARY FAUCET, A SANITARY FAUCET HAVING A FASTENER AND A METHOD FOR SECURING A SANITARY FAUCET TO A SUPPORT

This invention relates to a fastener for a sanitary faucet, to a sanitary faucet having a such fastener and to a method for securing a sanitary faucet to a support. Such sanitary faucets are used, in particular, to provide a liquid on demand at a washbasin, sink, shower and/or bathtub.

A sanitary faucet regularly has a faucet body that is secured to a support, such as a wall, countertop, sink, sink, shower, or bathtub. When using the sanitary faucet, lime, for instance, or other impurities which are difficult to remove, can build up on the support in the area of the sanitary faucet over time.

Therefore, the invention addresses the problem of solving at least a part of the issues described with reference to the prior art and, in particular, of providing a fastener for a sanitary faucet that renders cleaning the support particularly easy. In addition, a sanitary faucet is to be specified, the fastener of which facilitates cleaning the support. Furthermore, a method for securing a sanitary faucet, by which a support of the sanitary faucet can be cleaned more easily, is also to be disclosed.

These problems are solved by a fastener, a sanitary faucet and a method having the features of the independent claims. Further advantageous embodiments of the invention are specified in the dependent claims. It will be appreciated that the features listed individually in the dependent claims may be combined in any technologically useful manner and define further embodiments of the invention. In addition, the features indicated in the claims are further specified and explained in the description, wherein further preferred embodiments of the invention are illustrated.

A fastener for a sanitary faucet, having at least the features listed below, contributes to solving the problem:

- a coupling body that can be at least partially secured in an opening of a support, wherein the sanitary faucet can be detachably secured to the coupling body;
- at least one supply channel through which a liquid can be supplied to the sanitary faucet; and
- at least one valve that opens the at least one supply channel when the sanitary faucet is secured to the coupling body and closes the at least one supply channel when the sanitary faucet is not secured to the coupling body.

The sanitary faucet is used for instance to provide a liquid, in particular water, at a sink, washbasin, shower or bathtub. The sanitary faucet may have a faucet housing that is preferably at least partially made of (cast) metal, such as brass, and/or plastic. The faucet housing can have an outlet that is rigidly or movably, in particular in a swiveling and/or at least partially extendable manner, secured to the faucet body.

The sanitary faucet can have at least one liquid channel through which at least one liquid can be directed to at least one outlet opening of the sanitary faucet. The at least one outlet opening can be formed on the faucet body or the outlet of the faucet body. The liquid can flow out of the valve body via the outlet opening, for instance. For this purpose, the at least one liquid channel for the liquid can be formed in the faucet body. Further, the sanitary faucet can have a mixing valve, which can be used to mix cold water at a cold-water temperature and hot water at a hot-water temperature to form mixed water at a desired mixed-water temperature. The cold-water temperature is in particular at most 25° C. (Centigrade), preferably 1° C. to 25° C., particularly preferably 5° C. to 20° C. and/or the hot-water temperature is in particular at most 105° C., preferably 25° C. to 105° C., particularly preferably 55° C. to 105° C. The mixing valve can be, for instance, a mixing cartridge or thermostatic cartridge. The cold water and the hot water can each be supplied to the mixing valve via a liquid channel of the sanitary faucet. The sanitary faucet can have at least one actuating element. The at least one actuating element can be, for instance, an actuating handle, an actuating button and/or an actuating lever. The at least one control element can be used in particular to control the dispensing of the liquid or a property of the liquid. In particular, the at least one control element can be used to set the mixed-water temperature, a withdrawal quantity of the liquid and/or a type of liquid (for instance having a desired flavor). Furthermore, it can also be provided that the mixing valve or a shut-off valve can be actuated by the at least one actuating element.

The fastener is used to secure the sanitary faucet to a support, such as a wall, countertop, sink, washbasin, shower, or bathtub. To this end, the fastener has a coupling body. The coupling body can be designed in the manner of a housing and/or be at least partially made of metal, such as brass, or plastic. Furthermore, the mounting plate may be a plastic injection-molded part. In addition, the gate valve can in particular be at least partially cylindrical/or tubular in shape. Furthermore, the coupling body can be multi-part, for instance comprising a plurality of coupling body parts. The coupling body can be at least partially secured in an opening of the support. The opening can, for instance, be designed in the manner of a tap hole and/or a drilled hole. Furthermore, the sanitary faucet can be detachably secured to the coupling body. For this purpose, the sanitary faucet can in particular be at least partially inserted into the coupling body and/or screwed/bolted to the coupling body. In particular, the sanitary faucet can be re-detached from the coupling body without damaging the coupling body.

The fastener has at least one supply channel through which the liquid can be supplied to the sanitary faucet. For this purpose, the fastener can be connected, for instance, to a supply line for the liquid, for instance in the manner of a hose or a pipe. The at least one supply channel is in particular, formed inside the coupling body. In particular, the fastener can have a first supply channel for the cold water and a second supply channel for the hot water. Accordingly, the fastener may be connectable to a cold-water supply line and a hot-water supply line.

Furthermore, the fastener has at least one valve that opens the at least one supply channel when the sanitary faucet is secured to the coupling body and closes the at least one supply channel when the sanitary faucet is not secured to the coupling body. In particular, the at least one valve can be normally closed. In particular, this can mean that the at least one valve is in a closed position without being actuated, such that no liquid can flow through the at least one supply channel. The at least one valve can be actuated by the sanitary faucet through the attachment of the sanitary faucet to the coupling body such that the at least one valve can be adjusted to an open position, in which liquid can flow through the at least one supply channel to the sanitary faucet. The at least one valve can, for instance, be actuated mechanically, via a mechanism and/or electrically, for instance via an (electrical) switch.

The sanitary faucet can be easily mounted to and dismounted from the support by means of the fastener, wherein detaching the sanitary faucet from the fastener automatically results in the closing of the at least one valve or the at least one supply channel for the liquid. This means that the liquid supply to the sanitary faucet does not have to be interrupted manually, for instance by means of angle valves. Thus, the sanitary faucet can be detached from the support with little effort, rendering cleaning the support easier.

The at least one valve can have a valve body that is pressed in the direction of a valve seat by means of a spring. In particular, the valve seat can be formed by the coupling body. When the valve body is on the valve seat, the at least one valve or the at least one supply channel is closed. The spring may in particular be a coil spring, which may for instance extend at least partially around the valve body. Furthermore, the spring can be supported in particular by a first longitudinal end at the coupling body and/or by a second longitudinal end at the valve body.

A valve body of the at least one valve may be adjustable by the sanitary faucet when the sanitary faucet is secured to the coupling body. In particular, this may mean that the sanitary faucet lifts the valve body off the valve seat against a spring force of the spring such that the at least one valve or the at least one supply channel is at least partially open when the sanitary faucet is secured to the coupling body. If the sanitary faucet is not or not completely secured to the coupling body, the valve body is pressed back onto the valve seat by the spring such that the at least one valve or the at least one supply channel is closed again.

The coupling body may have a mount for the sanitary faucet. In particular, the mount may be formed at a longitudinal end of the coupling body. In particular, the sanitary faucet can be arranged at least partially in the mount or inserted into the mount. For this purpose, the mount can in particular have an inner diameter that is (substantially) equal to an outer diameter of an area of the sanitary faucet, which can be used to arrange or secure the sanitary faucet in the mount. In particular, the sanitary faucet can be arranged or secured in the mount (substantially) without play. Furthermore, the sanitary faucet can be secured in particular rotatably in the mount.

The at least one supply channel can open into the mount. In particular, the at least one supply channel may terminate at a bottom of the mount.

The fastener may have at least one locking element for securing the coupling body in the opening of the support. The at least one locking element can, for instance, be annular and/or arranged on an outer surface of the coupling body. Furthermore, the at least one locking element can be adjustable, for instance, against an underside of the support, such that the fastener can be clamped to the support, for instance.

In accordance with another aspect, a sanitary faucet is also proposed, comprising at least the components listed below:

a faucet body having an outlet; and a fastener according to the invention.

The sanitary faucet may have an adapter for connecting the faucet body to the fastener. In particular, the adapter is secured at the faucet body. In particular, the adapter can be used to insert the sanitary faucet into the mount of the coupling body of the fastener. In particular, an outer shape of the adapter is adapted to an inner shape of the mount. For instance, an outer diameter of the adapter may (substantially) be equal to the inner diameter of the mount.

The sanitary faucet can have at least one backflow preventer, which can be used to at least partially prevent a backflow of a liquid into at least one supply channel of the fastener.

For further details of the sanitary faucet, please refer to the description of the fastener.

According to yet another aspect of the invention, a method of securing a sanitary faucet to a support is proposed, comprising at least the steps outlined below:

a) securing a fastener according to the invention to the support; and b) securing the sanitary faucet to the fastener, whereby at least one valve of the fastener opens at least one supply channel of the fastener.

For further details regarding the process, please refer to the description of the fastener and the sanitary faucet.

Figure 2:
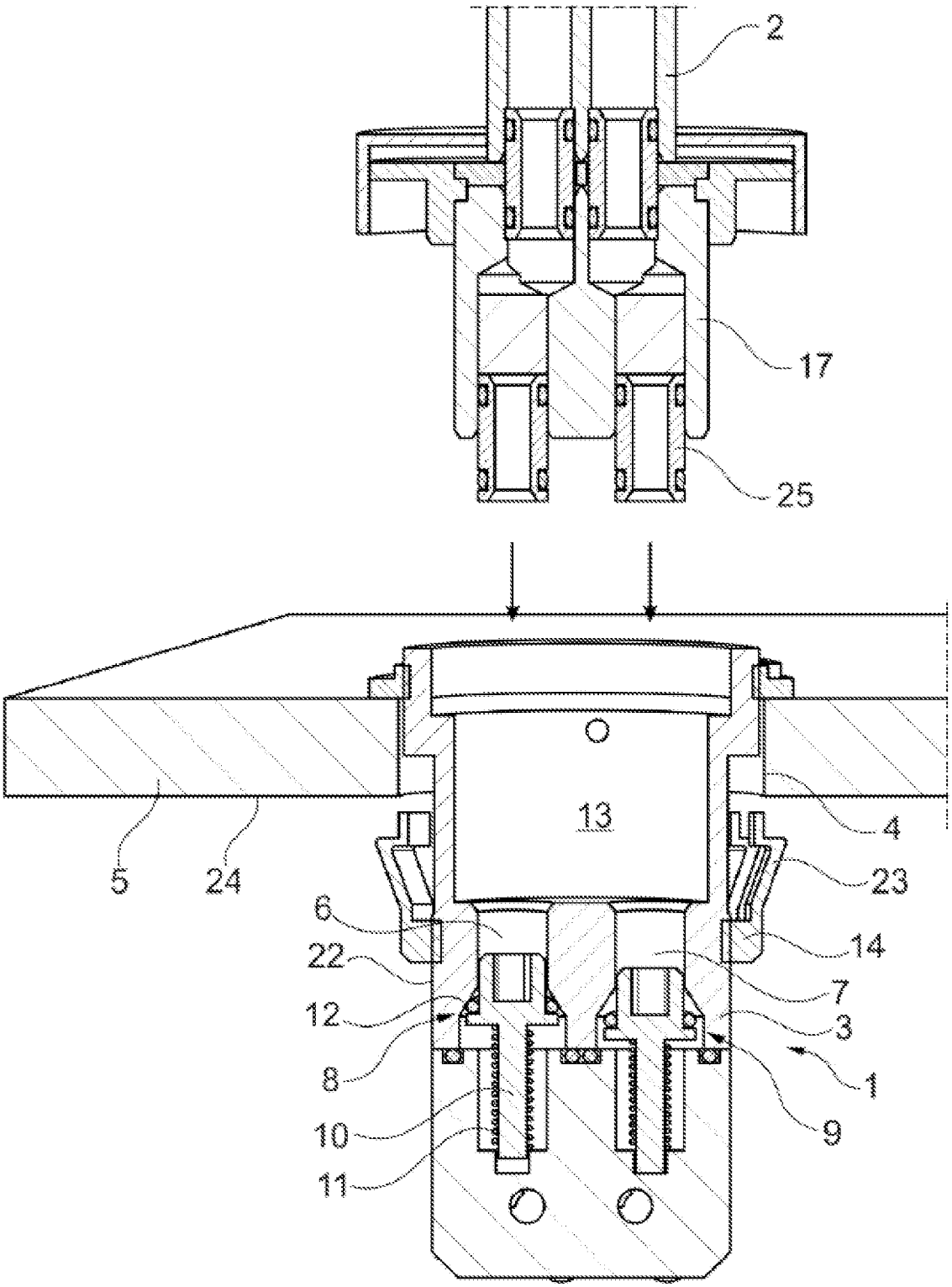
Figure 3:
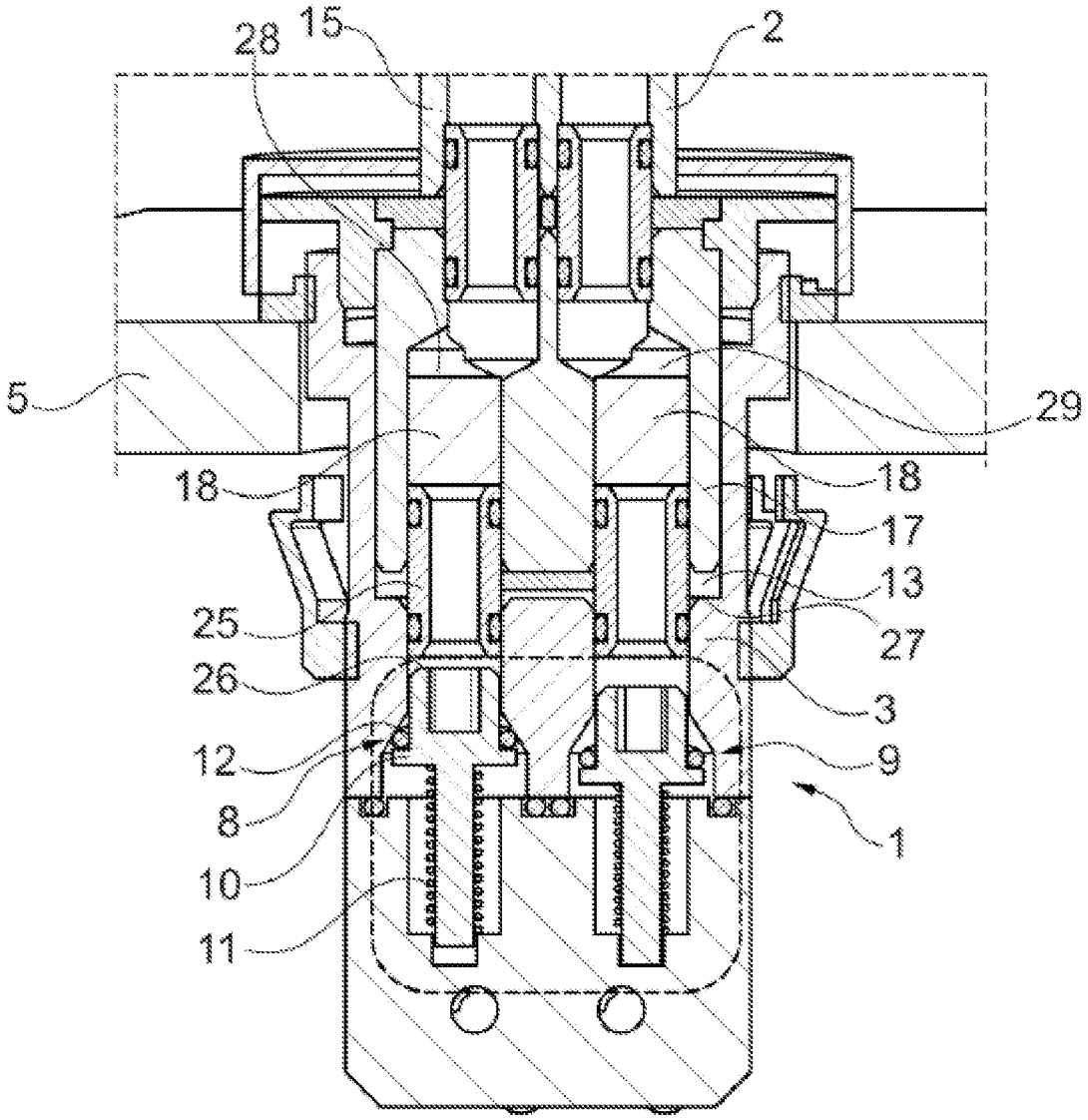

The invention and the technical environment are explained in more detail below with reference to the figures. It should be noted that the figures show a particularly preferred embodiment variant of the invention, but the invention is not limited thereto. The same reference numerals are used for the same components in the figures. In an exemplary and schematic manner, FIG. 1 shows a side view of a sanitary faucet;

FIG. 2 shows a longitudinal section of the sanitary faucet before its attachment to a support; and FIG. 3 shows a longitudinal section of the sanitary faucet while it is being secured to the support.

FIG. 1 shows a side view of the sanitary faucet 2. The sanitary faucet 2 has a faucet body 15, at the outlet 16 of which an outlet opening 19 is formed. Furthermore, the sanitary faucet 2 has a control element 20, which can be used to control a delivery of a liquid via the outlet opening 19. A fastener 1 is used to detachably secure the sanitary faucet 2 to a support 5 shown in FIGS. 2 and 3.

FIG. 2 shows a longitudinal section of the sanitary faucet 2 before its attachment to the support 5 in the area 21 shown in FIG. 1. The support 5 has an opening 4, in which a fastener 1 is secured. For this purpose, the fastener 1 has an annular locking element 14 with a snap hook 23 on an outer surface 22 of a coupling body 3. The locking element 14 can be adjusted along the outer surface 22 of the coupling body 3 against a lower surface 24 of the support 5, such that the coupling body 3 can be tightly secured in the opening 4. A first supply channel 6 and a second supply channel 7 are formed in the coupling body 3, which supply channels open into a mount 13 of the coupling body 3 for the sanitary faucet 2. Cold water can be supplied to the sanitary faucet 2 via the first supply channel 6 and hot water via the second supply channel 7. For this purpose, the fastener 1 can be connected to supply lines for the cold water and hot water, which are not shown here. A first valve 8 is arranged in the first supply channel 6, which closes the first supply channel 6 when the sanitary faucet 2 is not secured to the coupling body 3. For this purpose, the first valve 8 has a valve body 10 which is pressed against a valve seat 12 formed on the coupling housing 3 by a spring 11. A second valve 9 identical to the first valve 8 is arranged in the second supply channel 7. When the sanitary faucet 2 is inserted into the mount 13 of the coupling housing 3, the valve bodies 10 of the valves 8, 9 are pushed away from the valve seats 12 by connecting nipples 25 of an adapter 17 of the sanitary faucet 2, and the valve bodies 10 of the valves 8, 9 are moved to an open position. To illustrate this open position, the second valve 9 is shown with a valve body 10 lifted off the valve seat 12.

FIG. 3 shows the same longitudinal section as in FIG. 2 of the sanitary faucet 2 in its attachment to the support 5. In FIG. 3, the sanitary faucet 2 and the adapter 17 have been inserted into the mount 13 of the coupling housing 3 until the connecting nipples 25 of the adapter 17 reach an end face 26 of the valve body 10. When the sanitary faucet 2 is further inserted into the fastener 1 until the adapter 17 is seated on a bottom 27 of the mount 13, the valve bodies 10 of the first valve seat 8 and second valve seat 9 are moved from the valve seats 12 to an open position. This open position is shown for the second valve 9. In the open position, the sanitary faucet 2 can be supplied with cold water via the first supply channel 6 and with hot water via the second supply channel 7. The faucet body 15 of the sanitary faucet 2 can then be screwed/bolted to the fastener 1, such that the sanitary faucet 2 is secured to the support 5. When the sanitary faucet 2 is re-detached from the fastener 1 and the adapter 17 is pulled out of the mount 13, the valve bodies 10 are automatically again pressed against the valve seats 12 by the springs 11, closing the first supply channel 6 and the second supply channel 7. In the adapter 10, one backflow preventer 18 is arranged in a first liquid channel 28 for the cold water and in a second liquid channel 29 for the hot water, respectively, which prevent the cold water and hot water from escaping via the connecting nipples 25 when the sanitary faucet 2 is detached.

The fastener 1 can be used to detach the sanitary faucet 2 from the support with little effort, i.e., the support can be cleaned more easily.

LIST OF REFERENCE NUMERALS AND TERMS

1 fastener
2 sanitary faucet
3 coupling body
4 opening
5 support
6 first supply channel
7 second supply channel
8 first valve
9 second valve
10 valve body
11 spring
12 valve seat
13 mount
14 locking element
15 faucet body
16 outlet
17 adapter
18 backflow preventer
19 outlet opening
20 control element
21 area
22 outer surface
23 snap hook
24 bottom end
25 connecting nipple
26 end face
27 floor
28 first liquid channel
29 second liquid channel

The invention claimed is:

1. A fastener (1) for a sanitary faucet (2), comprising:

a coupling body (3) that can be at least partially secured in an opening (4) of a support (5), wherein the sanitary faucet (2) can be detachably secured to the coupling body (3);

at least one supply channel (6, 7) through which a liquid can be supplied to the sanitary faucet (2);

at least one annular locking element (14) for securing the coupling body (3) in the opening (4) of the support (5), and at least one valve (8, 9) that opens the at least one supply channel (6, 7) when the sanitary faucet (2) is secured to the coupling body (3) and closes the at least one supply channel (6, 7) when the sanitary faucet (2) is not secured to the coupling body (3), wherein the at least one valve (8, 9) has a valve body (10) that is pressed in the direction of a valve seat (12) by means of a spring (11), and wherein the annular locking element (14) is arranged on an outer surface (22) of the coupling body (3) such that the annular locking element (14) engages with a lower surface (24) of the support (5) so that the fastener (1) is secured to the support (5).

2. The fastener (1) according to claim 1, wherein thea valve body (10) of the at least one valve (8, 9) can be adjusted by the sanitary faucet (2) when the sanitary faucet (2) is secured to the coupling body (3).

3. The fastener (1) according to claim 1, wherein the coupling body (3) has a mount (13) for the sanitary faucet (2).

4. The fastener (1) according to claim 3, wherein the at least one supply channel (6, 7) opens into the mount (13).

5. A sanitary faucet (1) comprising:

a faucet body (15) having an outlet (16); and the fastener (1) according to claim 1.

6. The sanitary faucet (1) according to claim 5, comprising an adapter (17) for connecting the faucet body (15) to the fastener (1).

7. The sanitary faucet (1) according to claim 5, comprising at least one backflow preventer (18) by means of which a backflow of a liquid into at least one supply channel (6, 7) of the fastener (1) can be at least partially prevented.

8. A method for securing a sanitary faucet (2) to a support (5), comprising the following steps:

a) securing the fastener (1) according to claim 1 to the support (5); and b) securing the sanitary faucet (2) to the fastener (1), whereby at least one valve (8, 9) of the fastener (1) opens at least one supply channel (6, 7) of the fastener (1).

* * * * *